United States Patent [19]

Jazdzyk, Jr.

[11] Patent Number: 4,962,931

[45] Date of Patent: Oct. 16, 1990

[54] GOLF PUTTER

[76] Inventor: Matt Jazdzyk, Jr., 2343 Golfview Dr., Apt. 101, Troy, Mich. 48084

[21] Appl. No.: 492,054

[22] Filed: Mar. 12, 1990

[51] Int. Cl.[5] ..... A63B 69/36; A63B 53/04

[52] U.S. Cl. ..... 273/164; 273/183 E; 273/183 D; 273/162 F

[58] Field of Search ..... 273/183 C, 183 D, 183 E, 273/186 A, 186 C, 162 R, 162 F, 163 R, 163 A, 164, 167 R, 167 D; D21/219

[56] References Cited

U.S. PATENT DOCUMENTS

| | | | |
|---|---|---|---|
| Re. 19,178 | 5/1934 | Spiker | 273/164 |
| 3,549,300 | 12/1970 | Pelz | 273/162 R |
| 3,884,477 | 5/1975 | Bianco | 273/183 D |
| 4,077,633 | 3/1978 | Studen | 273/164 |
| 4,128,244 | 12/1978 | Duclos | 273/164 |
| 4,369,974 | 1/1983 | Komperda | 273/183 D |
| 4,390,184 | 6/1983 | Rudell | 273/164 |
| 4,754,974 | 7/1988 | Kobayashi | 273/164 |
| 4,819,943 | 4/1989 | Szczepanski | 273/164 |

OTHER PUBLICATIONS

"Golf Digest"; Oct. 1988; pp. 54, 55 & 56.

*Primary Examiner*—George J. Marlo
*Attorney, Agent, or Firm*—Charles R. White

[57] ABSTRACT

This golf putter has a head portion with an upwardly extending hosel to which a shaft is secured for manual stroking of a golf ball by a golfer. The head of the putter has an upper surface with a camouflaging texture which simulates the color and texture of the grass covering of the putting green which obscures the shape of the putter head. With this camouflaging, highly visible indicia on the club head and spaced parallel fins equaling the diameter of the ball stand out so that the golfer can square the putter face with the putting line and accurately stroke the putter along the line to optimize the putt.

4 Claims, 1 Drawing Sheet

GOLF PUTTER

TECHNICAL FIELD

This invention relates to golf clubs and more particularly to a new and improved golfing putter for aligning and aiming the putter for stroking a golf ball on a green which features optimized visibility of alignment and sight lines on the putter and minimized visibility of the shape of the putter head itself allowing the golfer to optimize his concentration in stroking the ball in a direction that travels in a predetermined path on the green to an objective cup within the green.

BACKGROUND

Prior to the present invention Various golfing clubs, in particular golfing putters, have been provided with a wide variety of sighting lines and indicators on the upper surface of the heads thereof to assist the golfer in stroking the ball so that it follows a predetermined path toward an objective such as the green cup. Examples of such putting clubs can be found in U.S. Pat. Nos. 1,531,821, 2,859,972 and 3,955,819 as well as the wood club of U.S. Pat. No. 2,859,972.

DISCLOSURE OF THE INVENTION

The present invention is of the general category of the golfing clubs identified above, but provides a club head arrangement that allows optimization of the putter stroke and aim with minimized distraction resulting from the shape of the putter head itself.

Accordingly, with this invention, it is a feature, object and advantage of this invention to provide a new and improved golfing putter in which only the alignment sight lines are distinctly visible on the upper surface of the club head without distraction from the shape of the club head itself so that the golfer can readily align the club head squarely with the intended putting line and subsequently stroke the club for impacting the ball with accuracy so that it follows the path leading toward the objective.

Another feature, object and advantage of this invention is to provide a new and improved putter head which has an upper surface that is colored, textured and shaded to simulate the grass surface of the green so that the shape of the club head is in some degree indistinguishable from the green as observed by a putting golfer and because of the camouflaging effect of the upper surface contrasting and readily observable indicia on the club head is more effective for addressing a golf ball and squaring the putter head with the intended line of the putt and stroking of the club head for putting the ball along the intended line on the green.

Another feature, object and advantage of this invention is to provide a new and improved golfing putter having a head with laterally spaced and parallel fin portions which extend rearwardly from the main body of the head and which carry longitudinally extending indicia spaced at a diameter substantially equal to the diameter of the golf ball to provide readily observable sight lines to allow the golfer to stroke the golf ball along the intended line of the putt.

These and other features, objects and advantages of this invention will be more apparent from the following detailed description and drawings in which:

DETAILED DESCRIPTION OF THE DRAWINGS

Figure 1:
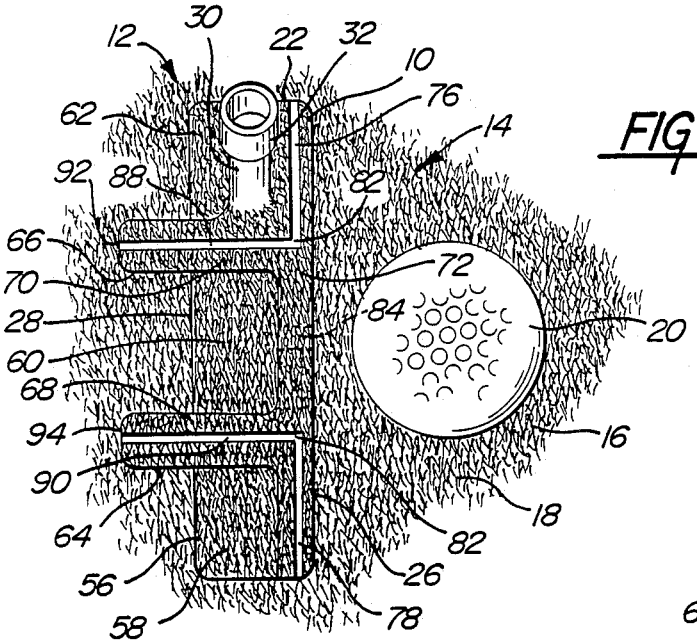
FIG. 1 is a top elevational view of the club head portion of a golfing putter and an associated golf ball on a green of a golf course.

Turning now in greater detail to the drawings, a generally rectangular shaped head 10 of a golf putter 12 made of brass, steel or other suitable material shown in FIG. 1 at rest on a golf green 14. The golf green has its upper surface conventionally covered with a growth of natural grass 16 such as bent grass which is wiry and low growing or Bermuda grass or other suitable green grasses. The grass is generally carefully mowed and maintained so that the individual grass blades 18 terminate at a point so that a smooth surface is formed that follows the contours of the ground that provide the base of the green 14. The grass covering is preferably sufficiently dense to provide good support of a spherical golf ball 20 so that it can be stroked by the golfer using putter 12 allowing it to roll on the green in a course line to a target provided by a cylindrical cup sunk into the ground base of the green.

The head 10 of the putter generally extends laterally from an inboard end or heel 22 to an outboard end or toe 24. Furthermore, the head has stepped upper surfaces that extend longitudinally from forward face 26 to an inclined back surface generally indicated at 28.

Projecting upwardly from a juncture point adjacent to the heel end of the head 10 is a hosel 30 that terminates in a cylindrical attachment collar 32. This collar has a cylindrical opening 34 which receives the lower end of a cylindrical putter shaft 36. A secure shaft-to-hosel connection is made at this juncture by braising or welding or other suitable joining means. A handle, not shown, is attached to the upper end of the shaft 38 so that the golfer can grip and stroke the putter to impact the golf ball in a manner in which the ball rolls in an intended path toward the cup.

The front 26 of the putter head 10 is preferably a slightly lofted surface extending from the lower edge to the top edge thereof and from heel to toe and from an upper beveled edge 40 to a lower radiused edge 42.

Figure 3:
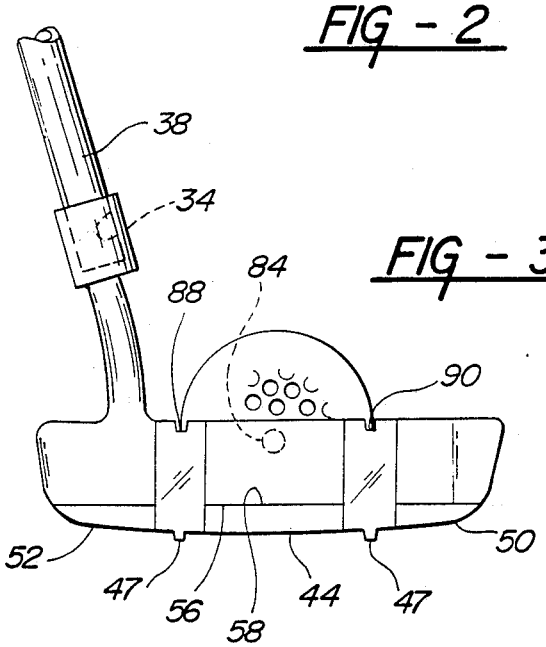
FIG. 3 is a rear elevational view of the golfing putter head of FIG. 1.
Figure 4:
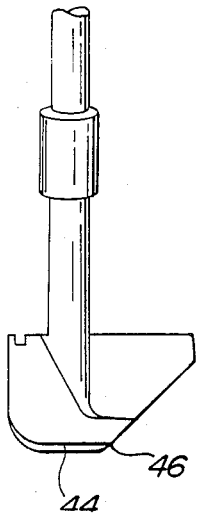
FIG. 4 is a heel-end view of the golfing putter head of FIG. 3.

From the radiused forward lower edge 42 a sole or bottom surface 44 of the putter extends longitudinally to a slightly radiused rear edge 46 that also extends from heel to toe. Laterally spaced runners 47 extending longitudinally across the bottom of the putter assist in guiding the putter in the putting stroke. These laterally radiused lower edges prevent the putter from scrubbing or digging into the green during the putting stroke in which the putter head is swung backward and then from the backward limit forward and preferably through the ball impact point so that the ball rolls on a predetermined course that leads to the cup within the green. Scrubbing is also minimized by the longitudinal curvature of portions 50, 52 of the sole of the club shown adjacent to the heel and sole as shown best in FIG. 3.

From the radiused lower rear edge the rear extremity of the head extends upward to the rear edge 56 of a lower, relatively flat surface separated into three distinct upper surface sections 58, 60 and 62 by geometrically shaped fin members 64 and 66. These fin members have substantially flat upper surfaces 68 and 70 that extend rearwardly from the upper surface 72 of the forward portion of the club head 10.

Figure 2:
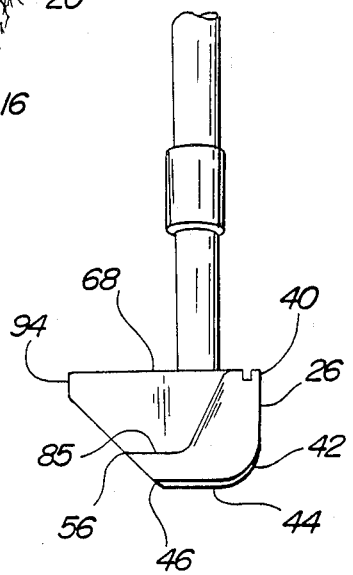
FIG. 2 is a toe-end view of the golfing putter head of FIG. 1.

The upper surface of the club head 10 has laterally extending alignment grooves 76, 78 aligned with each other and formed in the outer ends of the putter head and which extends respectively from the heel and toe ends to terminal intersecting points 80 and 82 which define the width of the ball and the outside diametral limits from the sweet spot 84 on the front face of the putter head. From the intersection points 80, 82 the sight lines 88, 90 formed in the upper surface of the fin portions of the putter head extend in parallel fashion to the rear ends thereof. These grooves are preferably equal to the diameter of ball 20 and importantly serve as sight lines when stroking the ball 20. From the rear ends of the upper surfaces of the fins, vertical rearward walls 92 and 94 are formed. From the lower edge of these walls, the rear surfaces taper downwardly to the curved rear edge 46 as shown in FIGS. 2 an 4.

As shown by FIG. 1, the upper surface sections of the putter 58, 60, 62 and 72 are colored and textured with paint or other suitable material and colored to closely simulate the color and texture of the grass surface of the green 14. Accordingly, the texturing may be provided by a base coat of green paint onto which individual paint strokes of darker green, brown, yellow and other selected colors can be added to simulate individual blades of grass of the green. This texturing is outside of the sight lines 88, 90 and the alignment grooves 76, 78 which are painted in white or any other color highly visible to the golfer using the putter. The upper surfaces of the putter head outside of the sight lines and grooves can be roughened or scored before painting for texturing purposes if desired.

With this construction, the golfer can grip the handle of the putter and stand so that his eyes look directly down at the ball as a starting place when scanning the path on the green in which the ball is planned to travel. Since the golfer has many difficulties with which to contend, since he is not on the same level of the ball or behind it, but above and at an unusual angle for getting a clear view of the putting line there is difficulty in aiming and stroking correctly.

However, with the present invention, the alignment grooves 76 and 78 can be kept square with the putting line of the ball without distraction from the camouflaged club head itself. With the club head swinging along the path and using the parallel and extended sighting lines 88 and 90 as guides, and without distraction from the shape of the club head, concentration and execution can be optimized for more effective putting of the ball. With the putter face squarely hitting the ball into the intended line the cup or the general area thereto is reached.

While but one embodiment of the invention has been shown and described, other modifications are possible within the scope of the following claims.

I claim:

1. A putter for optimizing the manual stroking of a spherical golf ball by a golfer in a preselected path on the natural grass putting surface of a green comprising a head portion of predetermined mass that has a forward surface for contacting the ball, manual shaft means attached to said head portion, said head portion having an inboard end defining a heel and an outboard end defining a toe, a sole extending from the lower end of said forward surface to a terminal end defining a rear surface, said putter having an upper surface, camouflaging texture means on said upper surface to simulate the color and textured surface of said green, readily visible indicia contrasting with said texturing means on the upper surface of said putter to allow the golfer to concentrate on the indicia to square the head of the putter with the intended line of the putt and allowing the golfer to stroke the putter along the intended line without distraction from the shape of said putter head because of said camouflaging texture means.

2. A putter for optimizing the stroking of a spherical golf ball in a preselected path on the natural grass putting surface of a green comprising a head portion of predetermined mass that has a forward surface for contacting the ball, said head portion having an inboard end defining a heel and an outboard end defining a toe, a sole extending from the lower end of said forward surface to a terminal end defining a rear surface, said putter having an upper surface, texturing means on said upper surface colored and camouflaged to simulate the surface of said green, contrasting, readily visible indicia on the upper surface of said putter to allow the golfer to concentrate on the indicia to square the head of the putter with the intended line of the putt and allowing the golfer to stroke the putter along the intended line without distraction from the shape of said putter head because of said camouflaging.

3. A golf putter for striking a ball on a grass surface comprising an elongated putter head, shaft means extending upwardly from said head to a terminal upper end for connection to a handle therefor for gripping by a golfer, said putter head having heel and toe portions, said putter head having a ball striking face at the front surface of the putter, a laterally extending front radiused lower edge that inhibits scrubbing into the putting surface when swinging the club head toward the ball, said club having an upper surface colored and textured to simulate the color and texture of the grass putting surface allowing the golfer to optimize concentration on squaring the head with the intended line of the putt and swing of the head along the intended line without distraction from the shape of the head.

4. A putter for optimizing the stroking of a spherical golf ball in a preselected path on the natural grass putting surface of a green comprising a head portion of predetermined mass that has a forward surface for contacting the ball, said head portion having an inboard end defining a heel and an outboard end defining a toe, a sole extending from the lower end of said forward surface to a terminal end defining a rear surface, said putter having an upper surface colored and textured to simulate the color and texture of the grass putting surface allowing the golfer to optimize concentration on squaring the head with the intended line of the putt and swing of the head along the intended line without distraction from the shape of the head, and laterally spaced and discrete fins extending rearwardly from said head portion spaced a distance from one another approximating the diameter of said golf ball, readily visible indicia on the upper surface of fins to facilitate the golfer's aim and swing of the head of the putter so that the ball travels along the intended line of the putt.

* * * * *